US009914560B2

(12) United States Patent
Cartlidge

(10) Patent No.: US 9,914,560 B2
(45) Date of Patent: Mar. 13, 2018

(54) BUCKET HANDLE

(71) Applicant: Robert D. Cartlidge, Pahokee, FL (US)

(72) Inventor: Robert D. Cartlidge, Pahokee, FL (US)

( * ) Notice: Subject to any disclaimer, the term of this patent is extended or adjusted under 35 U.S.C. 154(b) by 105 days.

(21) Appl. No.: 14/853,008

(22) Filed: Sep. 14, 2015

(65) Prior Publication Data

US 2017/0073114 A1 Mar. 16, 2017

(51) Int. Cl.
*B65D 25/32* (2006.01)
*A45F 5/10* (2006.01)
*B25G 3/04* (2006.01)

(52) U.S. Cl.
CPC ..... *B65D 25/32* (2013.01); *A45F 5/10* (2013.01); *A45F 5/102* (2013.01); *B25G 3/04* (2013.01)

(58) Field of Classification Search
CPC . B25G 1/102; B25G 3/32; B25G 3/18; B25G 3/16; B25G 3/20; B25G 3/02; B25G 3/04; B25G 3/12; B25G 3/14; B25G 3/26; A45F 5/10; A45F 5/102; A45F 5/1026; A45F 5/1046; A45F 2005/1053; A45F 2005/106; A45F 2005/1066; A45F 2005/103; A45F 2005/104; A47J 45/065; A47J 45/075
USPC ..... 16/411, 421, 422, 423, 425, 428, 431, 16/DIG. 12; 220/755, 759, 776; 294/67.1, 68.23, 164, 167, 171
See application file for complete search history.

(56) References Cited

U.S. PATENT DOCUMENTS

| | | | | |
|---|---|---|---|---|
| 384,279 | A | 6/1888 | Puffenberger | |
| 1,730,820 | A * | 10/1929 | Holden | A47J 45/08 16/431 |
| 2,654,115 | A | 10/1953 | Kafer | |
| 4,590,640 | A | 5/1986 | Enersen | |
| 4,823,433 | A | 4/1989 | Curtis | |
| 4,932,702 | A | 6/1990 | Sweeny | |
| 5,884,955 | A | 3/1999 | Pucillo | |
| 6,405,409 | B1 | 6/2002 | Zirella | |
| 7,174,605 | B1 | 2/2007 | Nawrocki | |
| 7,305,738 | B2 | 12/2007 | Nawrocki | |
| 7,805,813 | B1 | 10/2010 | Bunyard | |
| 2004/0093694 | A1 | 5/2004 | Fourie | |

* cited by examiner

*Primary Examiner* — Jeffrey Allen
*Assistant Examiner* — Kevin Castillo
(74) *Attorney, Agent, or Firm* — McHale & Slavin, P.A.

(57) ABSTRACT

A handle for attachment to a bail member of a bucket is disclosed. The handle includes a base formed from two interlocking members, a first member frictionally engages a second member, locking the two members together without tools. Upon the interlocking of the first member and second member, a base structure is formed providing a receptacle constructed in a range for receipt of the bail member along an upper section. A centrally disposed cavity may be included in the upper section for receipt of a tubular sleeve commonly found on buckets and employing bail members for carrying heavy weights. The base structure is positioned beneath the bail member wherein a portion of the bail member is insertable into the receptacle. A cover member is secured to the top section of the base structure to conceal the receptacle and secure the bail member within the handle.

5 Claims, 8 Drawing Sheets

BUCKET HANDLE

FIELD OF THE INVENTION

This invention relates to handles, and more particularly to handles for use with bails attached to containers, such as buckets and paint cans.

BACKGROUND OF THE INVENTION

The transporting of a container from place to place is typically performed by lifting the container with a bail member attached to the container. The bail member is a rigid piece of wire and operates as a handle. While the wire is capable of carrying the weight, the wire is typically made of a small diameter which can make transporting the container most difficult if the container has any weight. In many instances the bail member is attached to a container that is disposable.

By way of example, a bail member for a paint can is used only for as long as the paint within the can is viable. Once the paint is consumed, the empty paint can and associated bail wire is disposed of. For this reason, the bail wire is disposable and designed of a thin diameter wire suitable for the temporary use. The thin bail wire can literally cut into the hand of an individual lifting a container filled with paint or any other material. Some container manufacturers include a thin walled plastic sleeve positioned over a portion of the bail member to help distribute the weight when the can is lifted.

Another example is the conventional five-gallon container which is used to carry most anything. This may be temporary in manner, such as a container filled with oil, or a more general use, such as carrying soapy water to wash a boat. When filled with water, a 5-gallon container can weigh 40 pounds. Similar to a paint can, a thin wire bail member is attached to the container for use in transporting. In such an instance, the lifting of the container by hand places a tremendous pressure on the fingers. Again, it is common to place a small plastic sleeve over the bail member to help distribute the load. The sleeve helps, but a wider handle grip would further benefit the individual.

The need to help distribute the weight imposed upon the bail member is well known. Even if a plastic sleeve is present, if the hand of the individual moving the container is not hardened, the wire bail member can leave a mark, or even cause an injury to the muscles and tendons involved. This is especially problematic when the individual's hand is softened from working with water. In such instances, it is not uncommon for the individual to wear gloves or resort to some other means of distributing the weight across the individual's fingers.

Various attempts have been made to attach handles to the bail member so as to help distribute the weight. For instance, U.S. Pat. No. 6,405,409 discloses a handle cover for fitting over a wire bail handle affixed to a container. The handle cover is designed to fit over the wire bail, whether or not a hollow tubular sleeve through which the wire bail passes is present, and can interact with this sleeve when present. The handle cover is formed from two body members, at least one of which has a channel formed therein for receiving the wire bail. This channel has two end portions and a central portion. The central portion is wider than the end portions in order to receive a hollow tubular sleeve if present on the bail.

U.S. Pat. No. 7,805,813, discloses a grip for use with a bail coupled to a container and including an elongate tubular body for extending along a portion of the bail. The body has first and second opposite end portions and a central portion. The central portion can be grasped by a human hand and has a diameter of at least one inch. The first and second end portions have respective first and second engagement surfaces for contacting the bail in spaced-apart positions. The bail extends free of the body between the first and second engagement surfaces.

U.S. Pat. Nos. 7,174,605 and 7,305,738 disclose a handle that can be attached to wire-like members. The handle generally includes a handle portion, a retaining member, and a key member. The handle portion has a channel and an aperture extending from at least one outer surface of the handle portion into the channel. The channel is configured to receive at least a portion of a wire-like member therein. The retaining member is configured to be received within the channel. The retaining member has an aperture. The key member is configured to be engaged within the handle portion's aperture and the retaining member's aperture. Engagement of the key member within the retaining member's aperture can inhibit the egress of the retaining member from the channel to operatively trap at least a portion of a wire-like member within the channel, and thereby attach the handle portion to the wire-like member.

U.S. Publication No. 2004/0093694 discloses a removable handle for cookware having an upper and a lower portion, a casing being dimensioned to at least partially receive a handle of an item of cookware and resiliently deformable zones located in the casing so that when the zones are urged together, they grip the handle of the item of cookware. The upper and lower portions of the casing are hingedly connected.

U.S. Pat. No. 5,884,955 discloses a handle grip and handle grip assembly for shopping baskets. A pair of identical handle grips are fabricated of molded plastic, each comprising a unitary body component and cover component connected by a hinge component. A handle element is seated in each body component and the corresponding cover component closes over the handle element and is locked to the body component. The cover components of the grips engage each other when the basket is carried and the weight of the basket increases the engagement force.

U.S. Design Pat. No. 384,279 discloses an ornamental design for a carrier handle. U.S. Design Pat. No. 372,865 discloses an ornamental design for a bag handle. U.S. Design Pat. No. 337,053 discloses an ornamental design for a shopping bag handle grip.

U.S. Pat. No. 4,932,702 discloses an auxiliary handle for use with containers such as bags, pails or cans having handle portions included therewith. The handle has a longitudinally arcuate base portion and a pair of side walls converging upwardly from opposite sides of the base portion.

U.S. Pat. No. 4,590,640 discloses a handle for lifting a plastic bag that includes one or more plastic loops adapted for allowing the bag to be carried in a person's hand. The handle comprises an elongated member having a recess extending along one side and dimensioned to receive the plastic loops.

U.S. Pat. No. 4,823,433 discloses a paint bucket handle accessory that includes a generally elongate grip or handle member for grasping in the hand by a user, with the gripper handle member including a groove extending generally the length of the member along the top side thereof. The groove is dimensioned to receive the wire loop handle of a conventional paint bucket. The accessory also includes a hook member extending outwardly and generally perpendicularly from an opposite side of the gripper handle member to terminate in a hook element. The hook element is dimensioned for hooking under the inwardly and downwardly projecting lip formed in the upper edge of a conventional paint bucket.

U.S. Pat. No. 2,654,115 discloses a handle which may be made in two parts and snapped over a carrying bail of a basket, pail, or like portable container.

What is lacking in the art is a handle manufactured from two members that, when interlocked, form a base capable of supporting a bail member without attachment to the bail member, wherein the handle can be secured to the bail member by use of a cover installed without tools.

SUMMARY OF THE INVENTION

Disclosed is a handle for attachment to the bail member of a bucket, pail, or the like container. Such containers are commonly found employing bail members, which consist of a wire extending from one side of the container to the other that allows an individual to grasp the container for ease of transport. The bail member typically includes a plastic sleeve, should the container be used to carry heavy weights, so as not to cause harm to the hand of the individual carrying the container. The handle includes a base structure formed from two interlocking members, a first member includes a projection, tab, or the like protrusion along an inner side surface. A second member includes a catch or the like receptacle along an inner surface for receipt of the first member, thereby locking the two members together without tools.

The interlocking of the first member and the second member creates a base structure having an upper structure section constructed in a range for receipt of the bail member. The placement of the base structure beneath the bail member results in the weight of the container being lifted, and supported by the bail member, to reside solely on the base structure. In this manner, the base structure can be transferred to other containers without further securement or the need to dissemble the structure and reassemble it.

For instance, if an individual is moving multiple containers, then the base structure can be moved from container to container without further attachment. The upper structure preferably includes a centrally disposed cavity for receipt of a tubular sleeve commonly found on bail members. The upper section having a channel on either side of the centrally disposed cavity for positioning of the wire bail member; the cover member is secured to the top section of the base structure to conceal the receptacle and secure a portion of the bail member within the receptacle.

An objective of the instant invention is to provide a handle for use in distributing the weight of a container so as to allow ease of movement, wherein the handle can be moved from container to container without any assembly or disassembly required.

Still another objective of the invention is to disclose a handle for use with containers that allows for coupling to bail members that include plastic sleeves.

Still another objective of the instant invention is to provide a low-cost method of manufacturing wherein two members forming an interlocking base can be assembled at the factory or in the field without tools.

Still another objective of the instant inventions is to provide a handle having an ergonomically shaped outer surface so as to distribute the weight of a container across an individual's fingers.

Yet still another objective of the instant invention is to provide a handle for use with containers that can be attached to the bail member by securing a portion of the bail member between the base and a snap on cover.

DETAILED DESCRIPTION OF THE INVENTION

Figure 1:
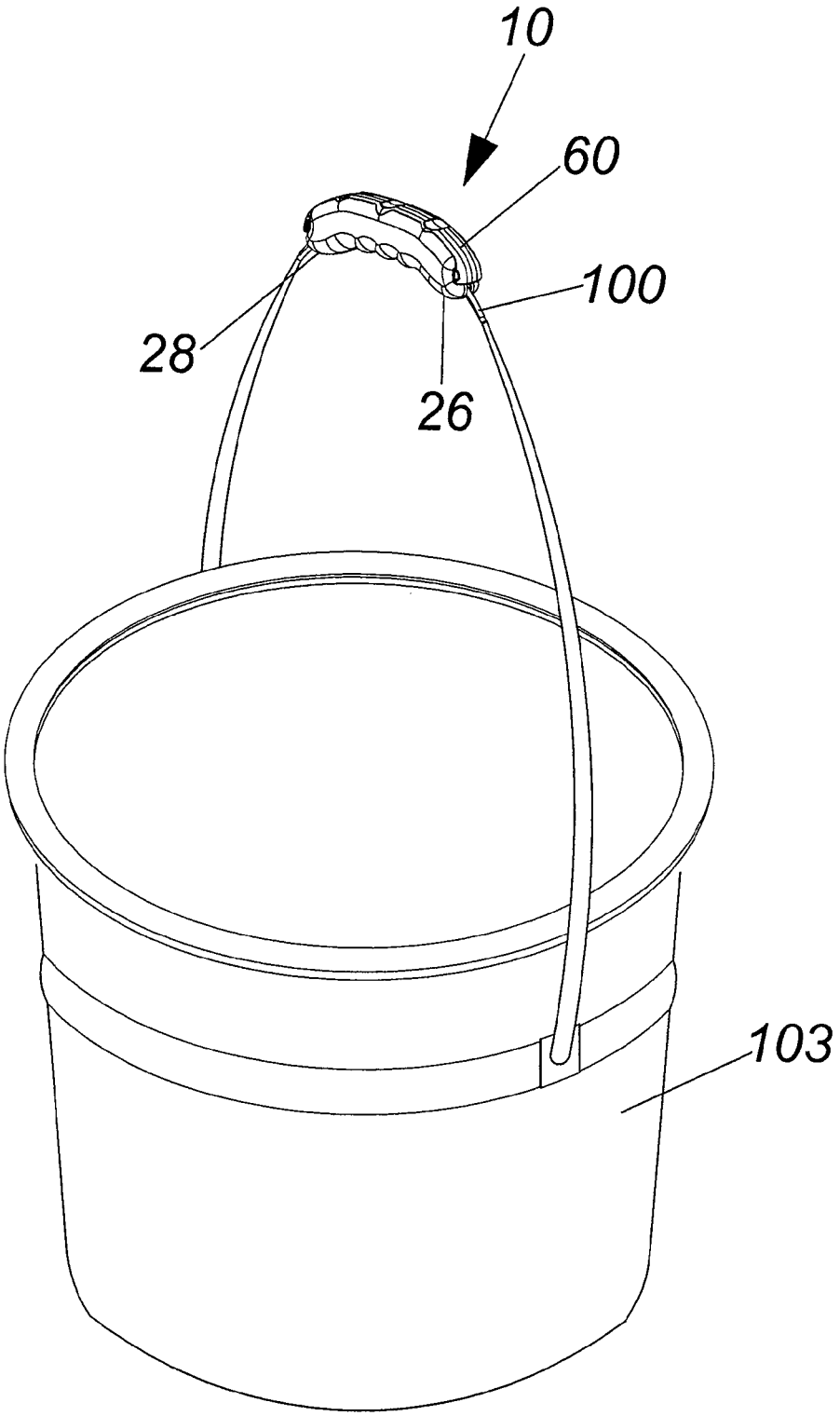
FIG. 1 is a perspective view of the handle.
Figure 2:
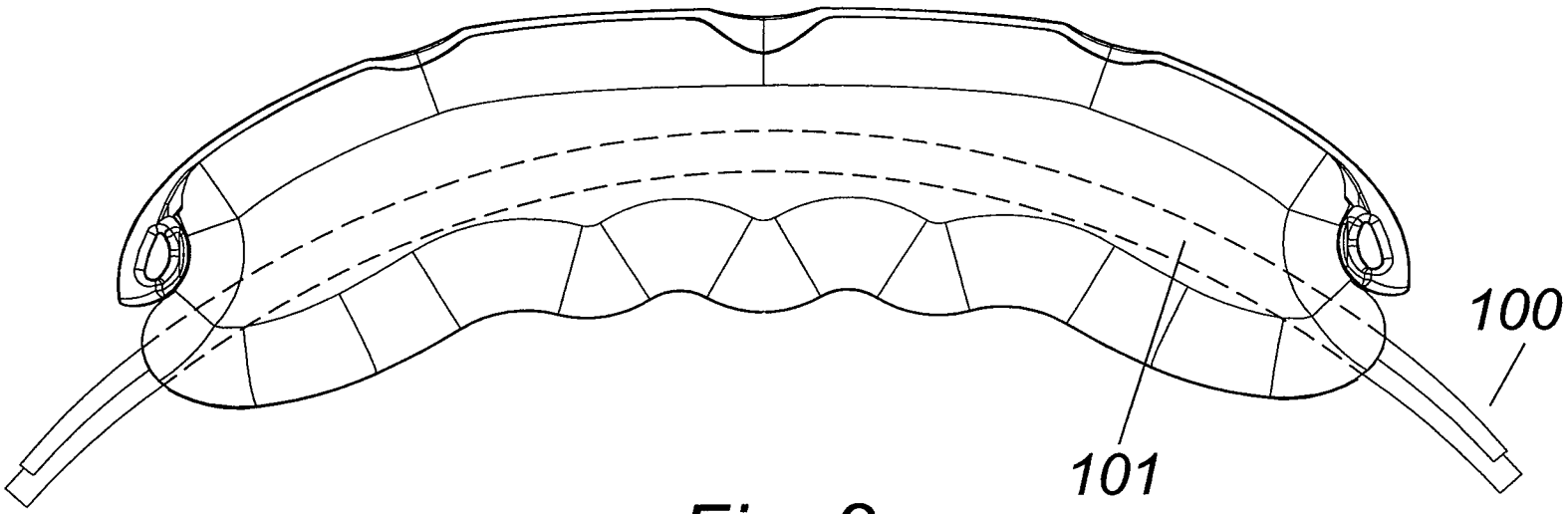
FIG. 2 is side view thereof.
Figure 3:
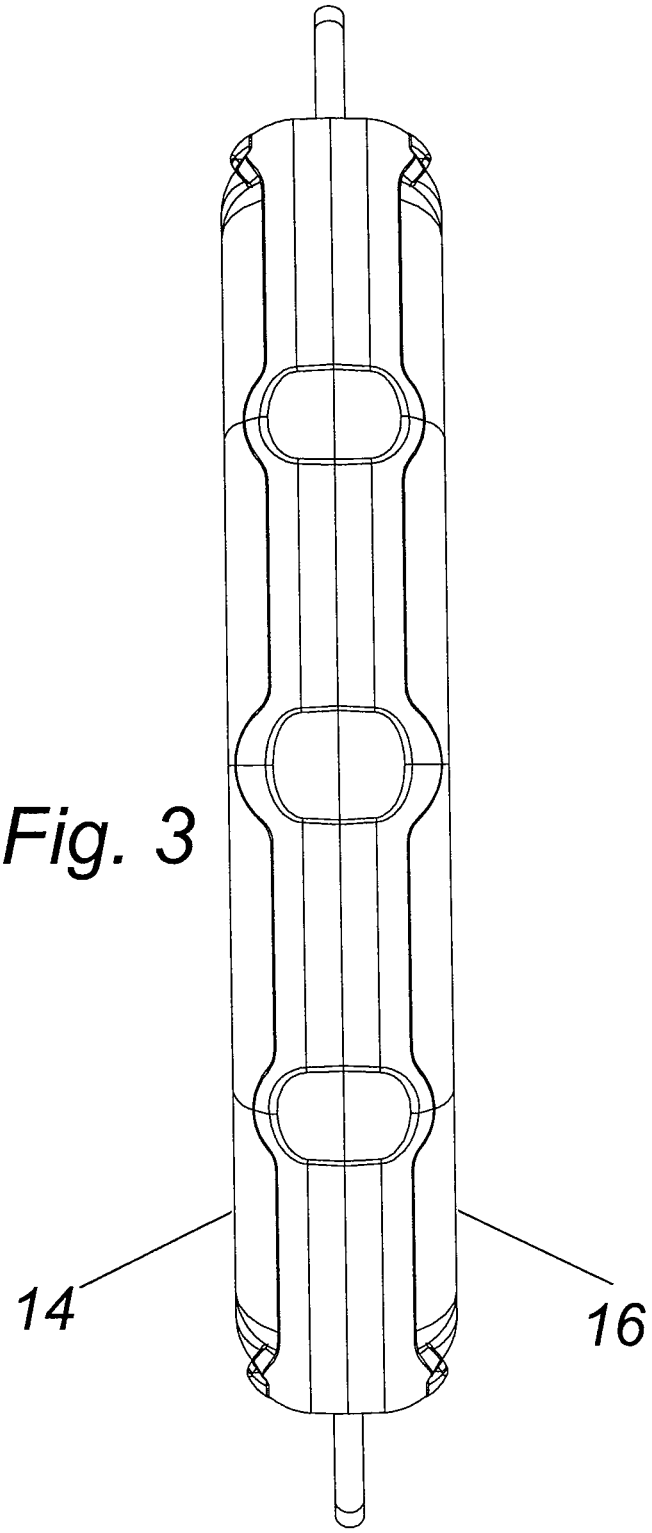
FIG. 3 is a top view thereof.
Figure 4:
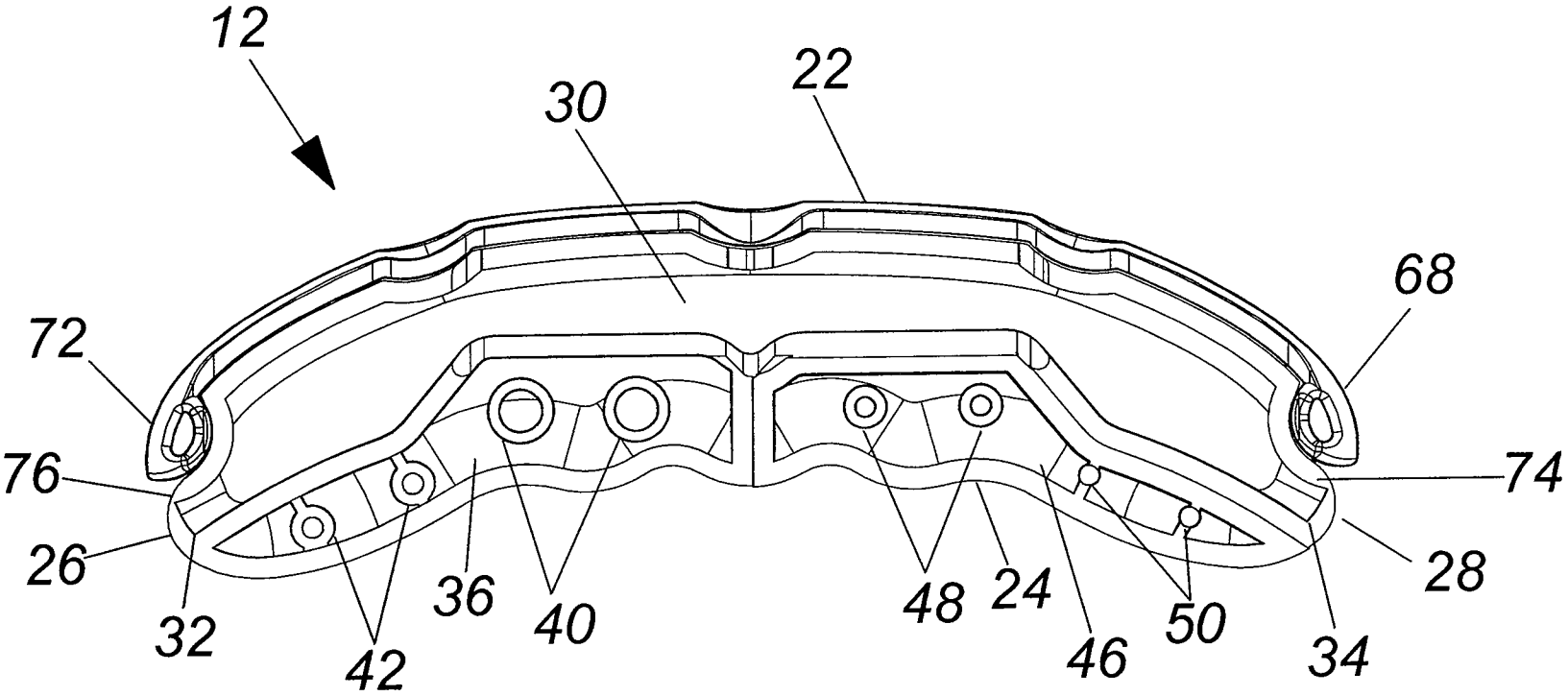
FIG. 4 is a side view of a member.
Figure 5:
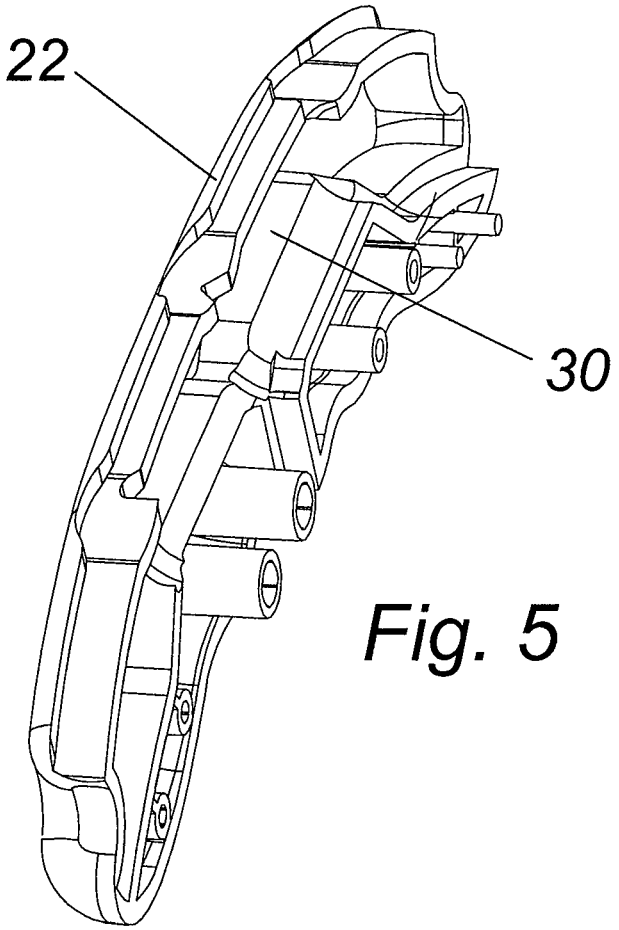
FIG. 5 is a perspective view of FIG. 4.
Figure 6:
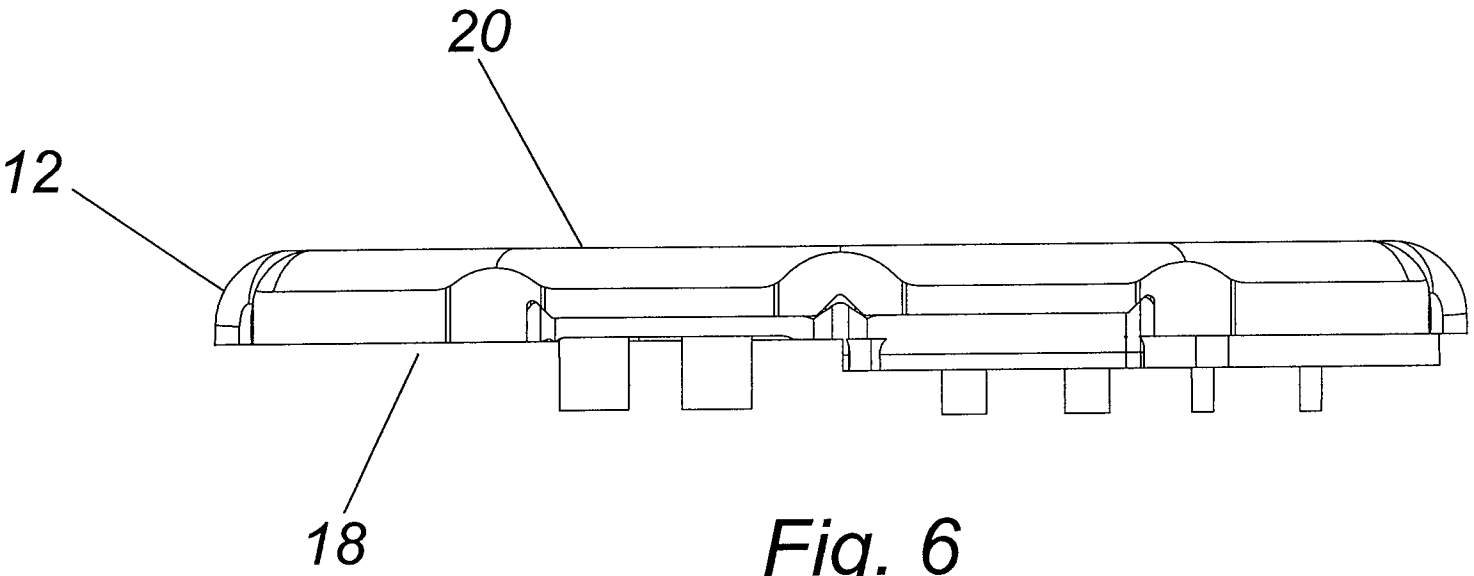
FIG. 6 is a top view of FIG. 4.
Figure 7:
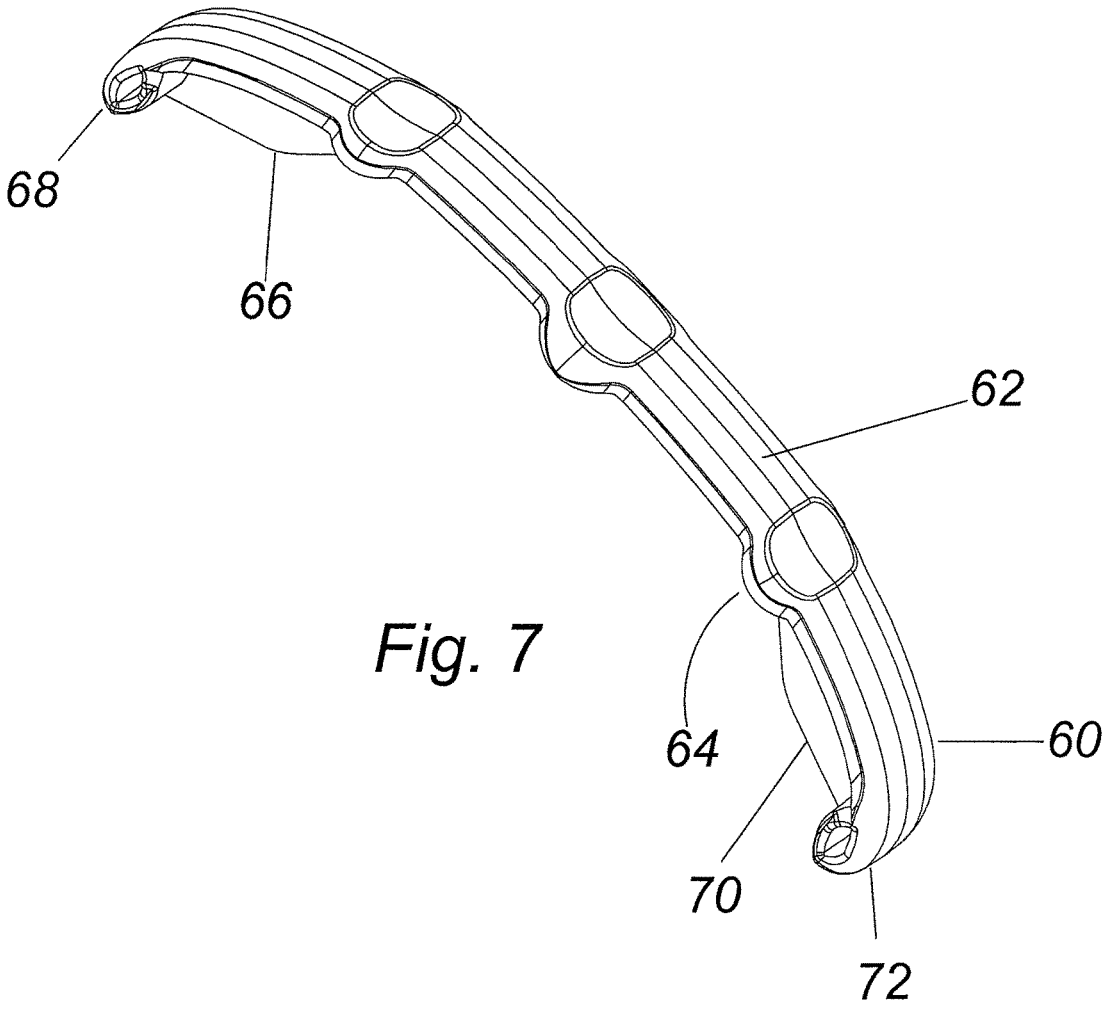
FIG. 7 is a perspective view of the top cover.
Figure 8:
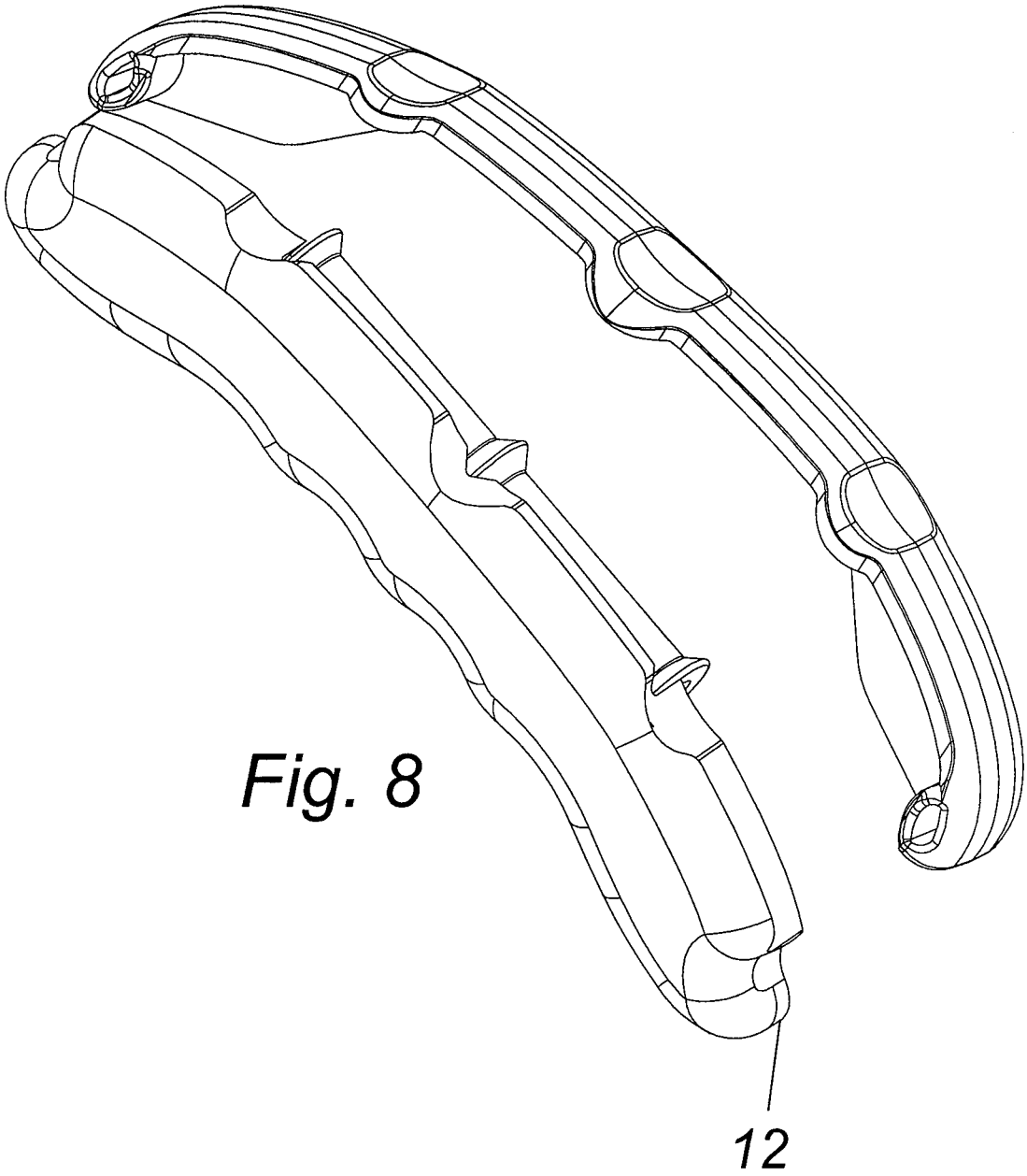
FIG. 8 is a perspective view of the base with the top cover.

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Now referring to the figures, set forth is a handle 10 for attachment to a wire bail member 100 of a bucket, paint can, or the like container. The handle 10 is formed from a base 12 comprising a first member 14 securable to a second member 16. The first member 14 and the second member 16 form a mirror image which allows a single mold to be used in the manufacturing of either member. For simplicity, the details of the first member 14 will be detailed with the understanding that the second member 16 is a duplicate member. The first member 14 has an inside 18 and an outside surface 20. The first member 14 is bounded by a top edge 22 and a bottom edge 24 with a first end 26 spaced apart from a second end 28. The first member 14 includes a centrally disposed cavity 30 positioned along the top edge 22 of the member 14.

A first bail member wire groove 32 is positioned between said cavity 30 and the first end 26. A second bail member wire groove 34 is positioned between the cavity 30 and the second end 28. A first engagement section 36 is positioned between the cavity 30 and the first bail member wire groove 32 and said first end 26. In the preferred embodiment, the engagement section employs fasteners to interlock one member to another. The first engagement section 36 includes two large receptacles 40 and two smaller receptacles 42. A second engagement section 46 is positioned between the cavity 30 and the second bail member wire groove 34 and the second end 28. The second engagement section 46 also includes two large protrusions 48 and two smaller protrusions 50. Because the second member 16 forms a mirror image of the first member 14, when the inner surfaces of the two members are interlocked, the larger protrusions 48 are inserted into the receptacles 40 of the adjoining member. Similarly the smaller protrusions 50 are inserted into the smaller receptacles 42 thereby locking a first member 14 to a second member 16. The protrusions and receptacles are constructed and arranged to frictionally lock together, the tolerances between the protrusions and receptacles is in the form of a taper so that once the members are interlocked, it is nearly impossible to separate them without damaging the members. The two members can be assembled at the factory, or by the consumer to create a base for support of the bail element. Once assembled, the mirrored cavity 30 becomes a receptacle sized to receive a bail wire 100 together with the plastic sleeve found on conventional buckets 103 that employ a bail wire. Similarly the grooves 32 and 34 form a mirror image for receipt of the bail wire 100 with or without the sleeve. It is understood that the size, type and configuration of the fasteners may vary and any arrangement will be deemed within the scope of this invention.

In operation, the two members forming the base provide a receptacle that can be placed beneath the sleeve on a bail wire and, upon lifting, place the sleeve within the cavity 30 and grooves 32, 34 to capture the bail, wherein the outer surface of the members provide a comfortable and expanded surface area for ease of lifting. The two members are interlocked but can be easily removed from the current bail wire and attached to another bail wire without tools or the need to disassemble the members. In this manner the handle formed by the two members can be moved from container to container quickly, like a portable handle. This is useful when moving multiple containers.

When a single container is used, the handle can be secured to the wire bail without tools. A cover member 60 constructed and arranged to extend from the first end 26 over the top edge 22 of the cavity 30 to the second end 28 for securing the bail wire within the cavity 30. The cover member 60 has an upper surface 62 and a lower surface 64 with a first spacing tab 66 placed at one end 68 and a second spacing tab 70 placed at the opposite end 72. The tabs 66 and 70 are constructed and arranged to fit between the upper edge 22 of the members 14 and 16. When the members 14 and 16 are being lifted, the tabs 66 and 70 are pinched therebetween. The end 68 is enlarged and constructed to fit within an indentation 74, and end 72 is also enlarged along the inner surface and constructed to fit within indentation 76 through a snap-fit arrangement. In particular, the cover member 60 is made of a memory material, such as plastic that can bent into a shape that conforms to the top edge 22 of the members 14 and 16. Upon extension, the cover member 60 snaps into the indentations 74, 76 securing the bail wire within the receptacle. It is noted that no pressure is placed upon the cover member during the lifting process that could force the cover member to become detached. Rather, the cover member tabs 66, 70 are squeezed to further hold the cover in place during lifting and no pressure on the cover member when the container is not in use. During the lifting procedure, the tabs 66, 70 provide proper spacing of the top edge 22 between the first 14 and second member 16.

The outer surface of the handle according to claim 1 wherein said outer surface 20 of said first and second member includes an ergonomic shape for the comfort of the individual. The members can be made of most any material including wood and steel, but the preferred embodiment is plastic.

All patents and publications mentioned in this specification are indicative of the levels of those skilled in the art to which the invention pertains. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A handle for attachment to a bail member of a bucket comprising:

a base formed from a first member securable to a second member, said first member having an inside and an outside bounded by a top edge and a bottom edge with a first end having a first indentation spaced apart from a second end having a second indentation, said first member including a centrally disposed cavity positioned along the top edge, a first bail member wire groove positioned between said cavity and said first end, a second bail member wire groove positioned between said cavity and said second end, and a first engagement section positioned between said cavity and said first bail member wire groove and said first end and a second engagement section positioned between said cavity and said second bail member wire groove and said second end, said second member interchangeable with said first member;

a plurality of fasteners placed in said first and second engagement sections;

a cover member having an enlarged first end constructed and arranged to provide snap fit securement to said base first indentation and an enlarged second end constructed an arranged to provide snap fit securement to said base second indentation, said cover extending from said first end over the top of said cavity to said second end, a lower surface of said cover member including spacing tabs constructed and arranged to fit between an upper edge of said first and second member, wherein lifting of said first and second member pinches said spacing tabs therebetween securing said bail wire within said cavity;

wherein the inside of said first member is aligned with the inside of said second member and pressed together whereby the fasteners in said first and second engagement section of said first member secure to the fasteners in said first and second engagement section of said second member;

wherein said centrally disposed cavities of said first and second member form a cavity for receipt of a bail wire sleeve and said first and second bail member wire groove are available for receipt of bail wire and said cover member frictionally engages said first member and said second member to secure said bail member wire within said cavity.

2. The handle according to claim 1 wherein said fasteners are further defined as a plurality of protrusions extending from said first engagement section located on said first member constructed and arranged to frictionally engage reciprocal sockets formed in said second engagement section located on said second member.

3. The handle according to claim 1 wherein said fasteners are further defined as a plurality of protrusions extending from said second engagement section located on one member constructed and arranged to frictionally engage reciprocal sockets formed in said first engagement section located on said first member.

4. The handle according to claim 1 wherein said outer surface of said first member and second member includes an ergonomic shape.

5. The handle according to claim 1 wherein said first, second and cover elements are constructed from plastic.

* * * * *